United States Patent [19]

Wojcik

[11] 3,936,227

[45] Feb. 3, 1976

[54] COMBINED COOLANT FEED AND DOVETAILED BUCKET RETAINER RING

[75] Inventor: Lawrence A. Wojcik, Peabody, Mass.

[73] Assignee: General Electric Company, Schenectady, N.Y.

[22] Filed: Jan. 23, 1975

[21] Appl. No.: 543,480

Related U.S. Application Data

[63] Continuation-in-part of Ser. No. 385,096, Aug. 2, 1973.

[52] U.S. Cl. ..... 416/95; 416/97 R

[51] Int. Cl.[2] ..... F01D 5/18

[58] Field of Search ..... 416/95–97, 416/92, 220, 221, 219; 415/115, 116

[56] References Cited

UNITED STATES PATENTS

| | | | |
|---|---|---|---|
| 2,647,368 | 8/1953 | Triebbnigg et al. | 415/116 |
| 2,985,426 | 5/1961 | Hunter et al. | 416/220 |
| 2,988,325 | 6/1961 | Dawson | 416/95 |
| 2,998,959 | 9/1961 | Haworth et al. | 416/221 |
| 3,009,682 | 11/1961 | Johnson | 415/115 |
| 3,446,482 | 5/1969 | Kydd | 416/193 A X |
| 3,619,076 | 11/1971 | Kydd | 416/96 X |
| 3,728,042 | 4/1973 | Hugoson et al. | 416/95 |
| 3,748,060 | 7/1973 | Hugoson et al. | 416/96 X |
| 3,814,539 | 6/1974 | Klompas | 416/95 |
| 3,856,433 | 12/1974 | Grondahl et al. | 416/97 |

*Primary Examiner*—Everette A. Powell, Jr.
*Attorney, Agent, or Firm*—Leo I. MaLossi; Joseph T. Cohen; Jerome C. Squillaro

[57] ABSTRACT

A gas turbine rotor in the rim of which liquid cooled dovetailed buckets are mounted is provided with at least one coolant feed/retainer ring shrunk fit to the side of the rotor and exerting positive axial force solely by means of a reverse angle fit. The configuration of the ring is such that an annular gutter is formed therein having equally spaced outlet holes therefrom disposed around the circumference thereof. Each of these holes is in flow communication with and forms part of at least one open-ended liquid cooling circuit servicing either the pressure or the suction side of a given turbine bucket. The feed holes function to meter the liquid coolant entering the cooling circuits.

6 Claims, 4 Drawing Figures

10
28
21
19
23
17
18
22
16
12
13a
14
13

10
29
28
32
31
33
27
3
3
28
26
19
21
24
23
21
22
18
17
16
16
11
13
12

COMBINED COOLANT FEED AND DOVETAILED BUCKET RETAINER RING

BACKGROUND OF THE INVENTION

This is a continuation-in-part of U.S. Pat. application Ser. No. 385,096 — Wojcik filed Aug. 2, 1973 and assigned to the assignee of this application.

The prime application for the instant invention is in connection with the liquid cooled dovetailed bucket construction such as is described and claimed in U.S. Pat. Nos. 3,856,433 — Grondahl et al.; 3,849,025 — Grondahl and 3,844,679 — Grondahl et al. These patents are incorporated by reference for the descriptions of various liquid cooling circuit configurations.

In a gas turbine rotor in which liquid cooled dovetailed buckets are mounted, the buckets must be maintained in the proper axial position during operation and, in addition, the requisite liquid coolant must be distributed to each bucket. The instant invention presents structure to simultaneously satisfy both of these needs.

SUMMARY OF THE INVENTION

Although a single coolant feed/retainer ring may be employed, preferably a pair of such rings is employed, one being affixed to each side of the turbine rotor. Proper positioning of the dovetailed buckets in the rotor rim is assured by the presence of these feed/-retainer rings, which are shrunk fit to the rotor and are also affixed thereto solely by means of a reverse angle fit. Proper distribution of liquid coolant to each bucket is assured by providing each ring with a configuration that includes, in addition to the provisions for the mounting thereof, an annular gutter in flow communication with open-ended liquid cooling circuits servicing the buckets via a series of equally spaced feed holes. Disposition of the feed holes relative to the buckets is assured by the engagement of each ring with a small locating pin on the rotor.

BRIEF DESCRIPTION OF THE DRAWING

The exact nature of this invention as well as objects and advantages thereof will be readily apparent from consideration of the following specification relating to the annexed drawings in which.

DESCRIPTION OF THE PREFERRED EMBODIMENT

Figure 1:
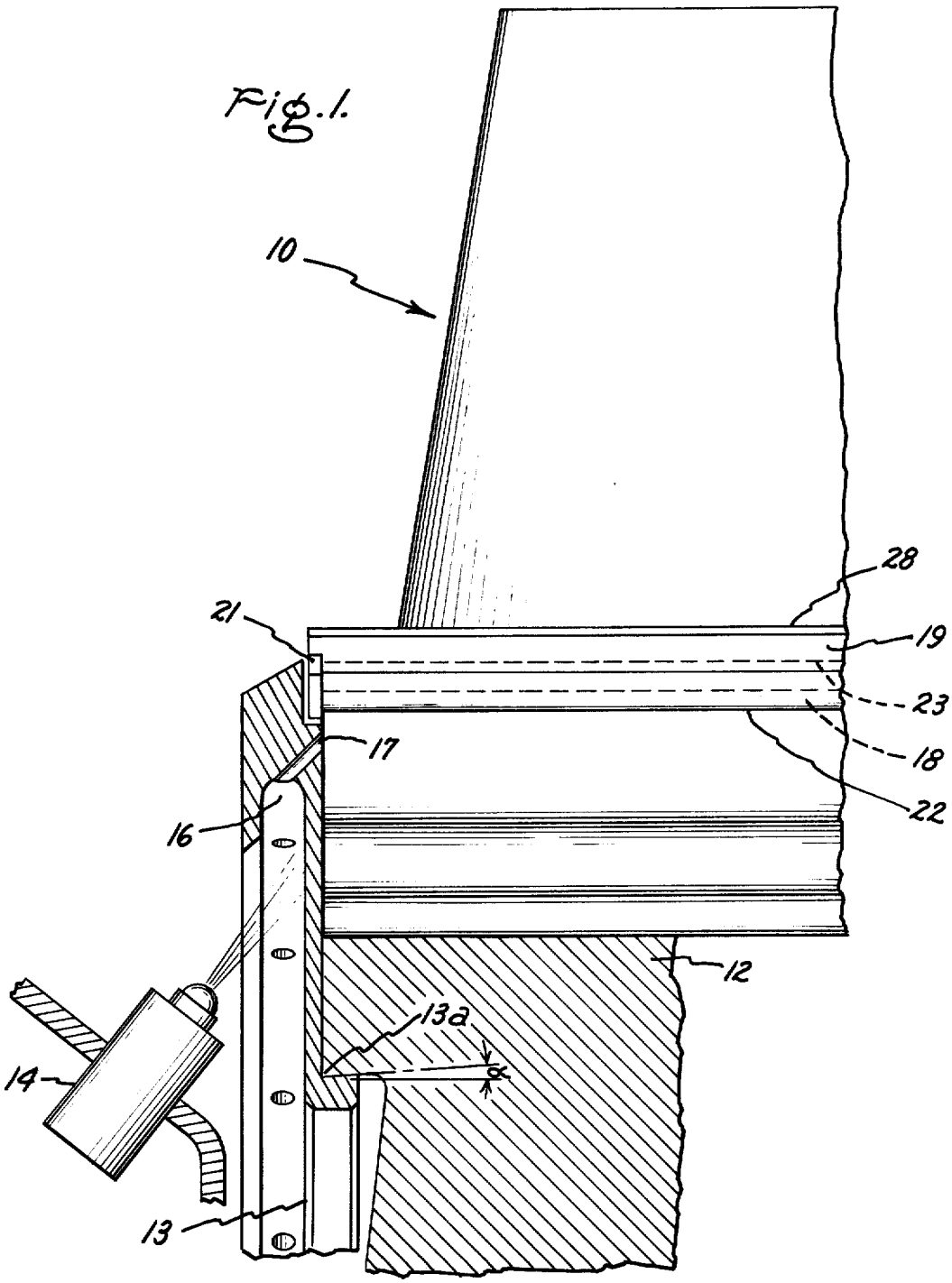
FIG. 1 is a view partially in section showing a side view in elevation of the turbine bucket configuration (dovetailed root, platform and airfoil) and the one-piece coolant feed ring of this invention in register therewith to supply liquid coolant to the open-ended liquid cooling circuit servicing one side of the turbine bucket.
Figure 2:
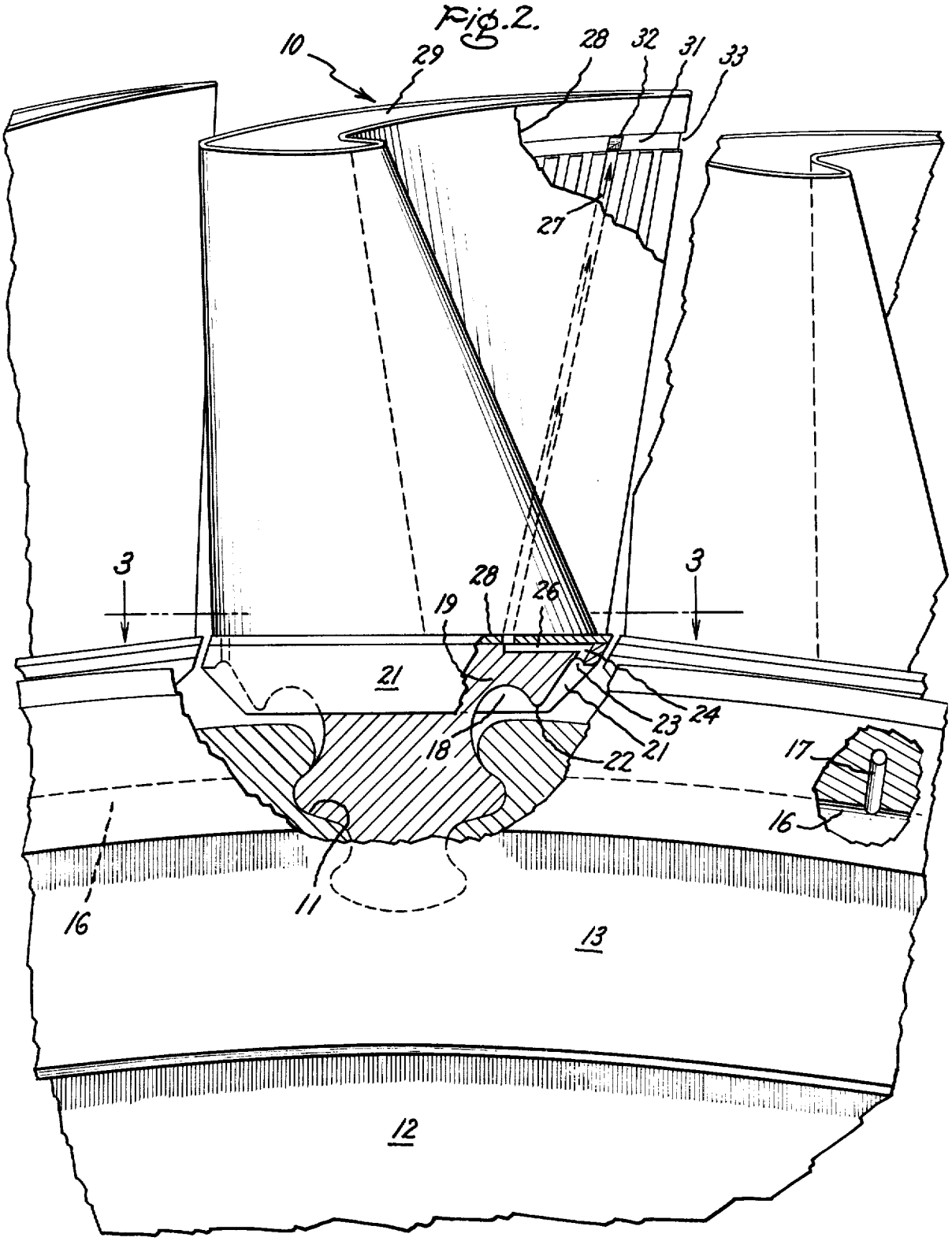
FIG. 2 is a view partially in section with the feed/-retainer ring and a cover plate partially cut away in the cooling circuit configuration selected to illustrate this invention the integral formation in the platform of the reservoir, longitudinally-extending metering means, platform coolant channels and coolant feed conduits leading thereto.
Figure 3:
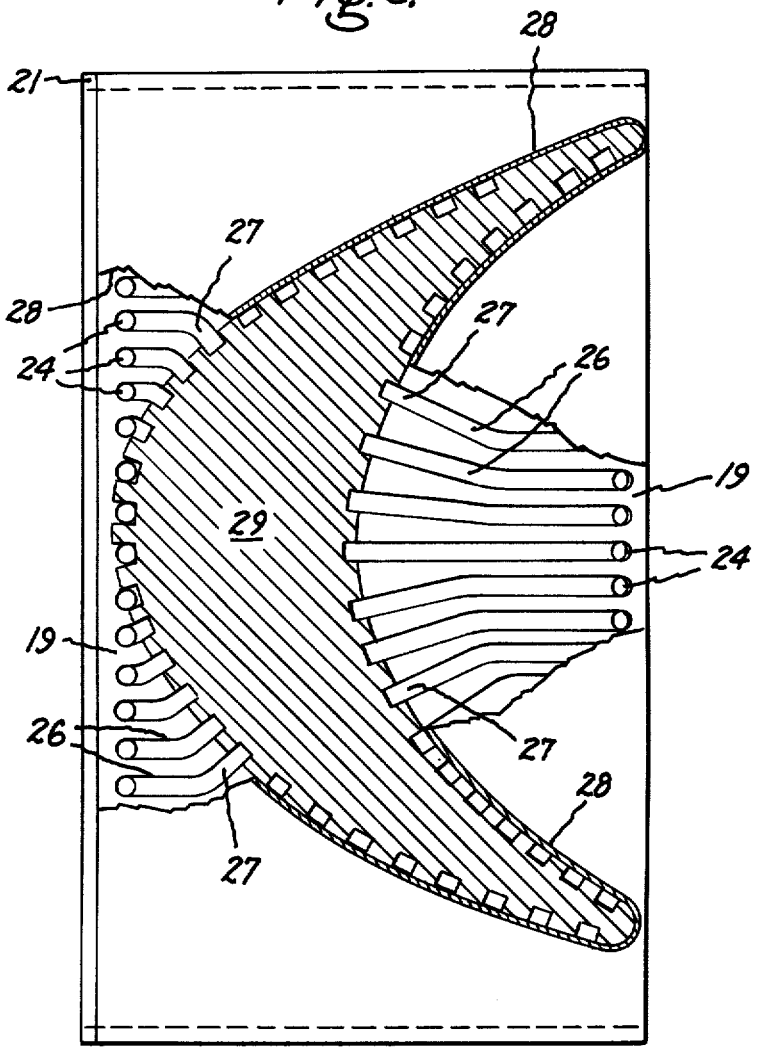
FIG. 3 is a view taken on line 3-3 of FIG. 2 with airfoil/platform skin removed in part to show the location and interconnection of the airfoil cooling channels, the platform cooling channels and feed conduits leading to the platform channels from the underside of the platform and FIG. 4 discloses an alternate construction by which a one-piece feed/retainer ring can be utilized to exercise still an additional function; namely, sealing the rotor wheel space.

Liquid cooled dovetailed buckets 10 are mounted in mating grooves 11 in turbine rotor rim 12. Retention of these buckets in the proper axial position is preferably insured by the application of positive pressure in the axial direction by one-piece annular feed/retainer rings (one shown) 13, one on each side of turbine rotor rim 12. A projecting annular lip formed on ring 13 is shrunk fit into an annular recess in rim 12 and, without additional fastening means, is affixed thereto by reliance on reverse angle $\alpha$ formed at the interface where the projecting lip and the wall of the recess overlap. The amount of shrink fit and the particular angle $\alpha$ selected depend on the relative coefficients of expansion of the ring material and the rotor material. Preferably, angle $\alpha$ will have a value in the range from 1°–10°. During operation, the retainer/feed rings expand with the rotor rim. Any action tending to displace rings 13 further in the radial direction than the radial movement of rotor rim 12 results in a rotating action of each ring 13 (to the extent possible) against the faces of rotor rim 12 around point (actually a circle) 13a and its counterpart, now shown. This action results in the application of positive axial force to maintain the dovetailed buckets in the proper axial position.

Reliance upon the use of the reverse angle in combination with the interference fit for joinder of the parts is preferred to attaching the rings 13 to the rotor rim by the use of fasteners such as bolts, rivets or bayonet joints, because these will introduce weakening holes or interruptions in the rings and rotor unnecessarily limiting the speed at which the turbine may be operated.

Removal and/or replacement of buckets 10 is easily accomplished without damage to the rings 13 by differentially cooling one ring 13 and the rotor 12 so that the thermal contraction of ring 13 is greater than the interference fit. Thereafter, the ring so shrunk and the bucket (or buckets) 10 may be removed.

In the function thereof as a liquid coolant distributing means, the feed/retainer ring 13 receives cooling liquid (usually water) sprayed at low pressure in a generally radially outward direction from nozzles (one shown) 14, preferably located on each side of the rotor disk. This cooling liquid impinges on ring 13 and enters the annular gutter 16, that forms part of the configuration of each one-piece ring 13. The coolant distributes itself as a thin film in gutters 16 and, under the influence of centrifugal force, leaves each gutter 16 via a plurality of feed holes 17. The plurality of openings to the feed holes 17 are equally spaced around the inner circumference of each gutter 16 in order to provide equal distribution of coolant to and through these feed holes.

In the construction shown liquid coolant passing through a given feed hole 17 enters a reservoir 18 located in the volume between the underside of the integral platform 19 and the radially outer surface of wheel rim 12. Longitudinally-extending reservoir 18 is closed at the far ends thereof by a pair of cover plates 21. Liquid coolant accumulates in reservoir 18 until there is sufficient coolant therein to fill the reservoir. As liquid coolant continues to arrive the excess discharges over the crest of arcuate weir 22 into longitudinally extending gutter 23, where the discharged coolant distributes as a thin film and enters cooling channel feed holes 24. Each of the holes 24 is connected on a one-to-one basis with either platform cooling channels 26 or directly into airfoil cooling channels 27. Thus, as described herein a pair of feed holes 17 disposed on opposite sides of the rotor would supply all of the cooling liquid to be distributed to a given bucket 10. Similarly, in applying the invention to serpentine cooling channel construction as disclosed in U.S. Pat. Nos. 3,849,025 and 3,844,679 (above) a pair of feed holes 17 disposed on opposite sides of the rotor may be used to meter all of the cooling liquid passing to a given turbine bucket.

As the cooling liquid moves through the various cooling channels constituting (together with feed holes 17, reservoirs 18, weirs 22, gutters 23 and feed holes 24) the open-circuit cooling system for any given bucket 10, a portion of the cooling liquid, depending upon the rate of flow, is converted to the gaseous or vapor state (as it absorbs heat from the skin 28 and core 29 of the bucket). Each cooling channel 26, of course, is in flow communication with a cooling channel 27 and at the outer ends of the cooling channels 27, the vapor or gas and any remaining liquid coolant passes into manifold 31 (and a similar manifold on the suction face). Thereafter, the flow in the suction manifold is merged with the flow in manifold 31 via a crossover conduit, the opening 32 of which is shown, and the combined flows exit therefrom via opening 33.

Figure 4:
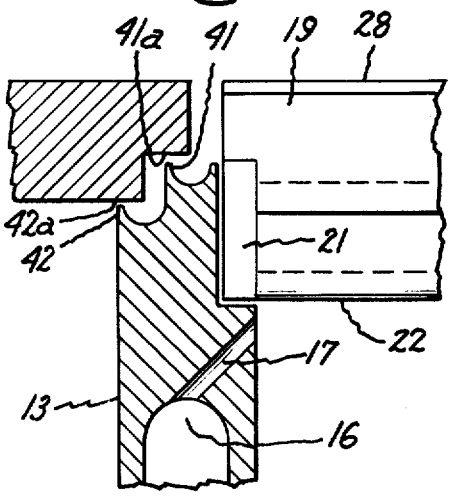

As is shown in FIG. 4, an alternate construction for one-piece ring 13 may be employed whereby annular ridges 41 and 42 are incorporated thereon and mating seating areas are provided on the stationary side walls as, for example, annular areas 41*a* and 42*a*. The rotor wheel space may be sealed in this manner.

The preferred arrangement for the utilization of this invention employs a pair of annular rings, one on each side of the turbine disk, both contributing coolant to the open-circuit coolant distribution paths. However, there are certain advantages to supplying coolant from one side only of the turbine disk providing that good distribution of the coolant along the reservoir can be assured. Thus, this invention is also intended to encompass an arrangement in which a single feed/retainer ring is employed having a configuration such as is described hereinabove. If a single such ring be employed, separate anchoring means for the dovetailed buckets would be required on the opposite side of the rotor. The rotor would have to be properly balanced to compensate for such a non-symmetrical construction and an adequate source would have to be provided to feed coolant to the gutter of the single ring.

What I claim as new and desire to secure by Letters Patent of the United States is:

1. In a gas turbine wherein a turbine disk is mounted on a shaft rotatably supported in a casing, said turbine disk extending substantially perpendicular to the axis of said shaft and having turbine buckets mounted on the outer rim thereof, each bucket having a dovetailed root, means located radially inward of said buckets adjacent said turbine disk for introducing liquid coolant within said turbine in a radially outward direction to an annular gutter to enter open-circuit distribution paths by which said coolant reaches and cools each of said buckets, each distribution path comprising a cooling channel/manifold system in one bucket for traversal of a portion of the bucket by the coolant followed by discharge thereof from the bucket, the improvement comprising, at least one one-piece annular member attached to said outer rim solely by means of an overlap in the generally axial direction between an annular portion of said member and an annular portion of said outer rim, the overlap being an interference fit conformed as a reverse angle, said annular member having an annular gutter formed therein, said gutter being in flow communication with the open-circuit coolant distribution paths via circumferentially spaced feed holes in said annular member.

2. The improvement of claim 1 wherein a pair of one-piece annular rings is employed, one on each side of the turbine disk, each of said rings having an annular gutter formed therein and each gutter being in flow communication with one half of the open-circuit distribution paths.

3. The improvement of claim 1 wherein the feed holes are equally spaced around the circumference of the annular gutter.

4. The improvement of claim 3 wherein each feed hole interconnects with one open-circuit distribution path.

5. The improvement of claim 1 wherein at least one annular ridge is formed along the outer periphery of the one-piece annular ring, said ridge co-acting with an annular portion on adjacent stationary structure of the turbine to seal the rotor wheel space.

6. The improvement of claim 1 wherein the reverse angle has a value in the 1°–10° range.

* * * * *